United States Patent [19]

Price

[11] 4,300,423

[45] Nov. 17, 1981

[54] APPARATUS FOR SEVERING AND SEPARATING CUP-SHAPED OBJECT SUPPORTS

[76] Inventor: Paul Price, Kirchlistrasse 1, 9010 St. Gallen, Switzerland

[21] Appl. No.: 91,196

[22] Filed: Nov. 7, 1979

[30] Foreign Application Priority Data

Nov. 8, 1978 [CH] Switzerland ..... 11475/78

[51] Int. Cl.[3] ..... B26D 3/00; B01L 11/00

[52] U.S. Cl. ..... 83/165; 83/167; 83/409.2; 83/435.1; 83/466.1

[58] Field of Search ..... 53/239, 435, 513, 522; 83/661, 870–874, 85, 97, 165, 167, 409, 409.1, 409.2, 415, 466.1, 435.1

[56] References Cited

U.S. PATENT DOCUMENTS

| | | | |
|---|---|---|---|
| 1,118,610 | 11/1914 | Winchester | 83/409.2 |
| 1,775,026 | 9/1930 | Hamwi | 83/85 |
| 2,821,254 | 1/1958 | Kernen | 83/870 |
| 3,430,415 | 3/1969 | Phillips | 53/513 |
| 4,072,077 | 2/1978 | Morgan | 83/409.2 X |
| 4,230,007 | 10/1980 | Grote | 83/409.2 |

*Primary Examiner*—James M. Meister
*Attorney, Agent, or Firm*—William R. Hinds

[57] ABSTRACT

For the purposes of severing and separating a plurality of cup-shaped object supports (2) of plastic material, which are interconnectedly arranged on a support plate (1), use is made of a method wherein the support plate (1) is first put into a gripping device (4) and secured therein. Subsequently a severing device (5) which is displaceable in the plane of the support plate (1) is set in motion to sever the cup-shaped object supports by means of a saw blade (14). The object supports (2) fall into the respectively associated glass reagent vessels (20) by way of distributor passages (18) which lead downwardly in a truncated pyramid configuration, which reagent vessels can be pushed into position below the distributor block (17) in a container carrier (19). The method according to the invention replaces the conventional operations of severing and separating the object supports (2) by a shears.

11 Claims, 5 Drawing Figures

APPARATUS FOR SEVERING AND SEPARATING CUP-SHAPED OBJECT SUPPORTS

The invention relates to a method for severing and separating a plurality of cup-shaped object supports of plastic material, which are arranged interconnectedly on a support plate.

Object supports or slides, also referred to as microtitre plates, are used primarily in large-scale series laboratory tests in medicinal matters. Thus for example, in connection with blood donors, it is necessary for the specimen of blood of each donor to be tested for the presence of jaundice viruses. In this operation, a sample of blood is put into each of the cup-shaped recesses, which makes it particularly easy to handle the specimens as long as these can be subjected to further processing as a group. At the end of the jaundice test however, it is necessary for each of the cup-shaped object supports to be put into a reagent glass vessel or another container separately.

This means that the support plate must be divided up. Hitherto, this operation of separating the filled object supports was carried out with a conventional pair of shears. However, this is a particularly time-consuming and long operation for the laboratory personnel. As the object carriers were hitherto treated in a given sequence, there is also the danger that the individual object supports may be confused with each other in the cutting operation. It has already been suggested that the individual object supports may be punched out of the support plate. However, this method was also unsatisfactory as the object supports remain clinging to the punching tool or to the remainder of the support plate, as a result of adhesion forces.

The problem of the present invention is therefore to overcome the disadvantages of the known art and in particular to provide a method whereby the cup-shaped object supports can be severed, separated and passed to the glass reagent vessels associated therewith, in a single working operation. It is therefore a further problem of the invention to design the method and apparatus for carrying out the method in such a way that there is no possibility of defective handling due to lack of attention. According to the invention, this problem is solved in that the support plate is inserted into a gripping means and fixed therein in such a way that each of the cup-shaped object supports is disposed in and/or above an opening associated therewith, that the object supports are then severed from the interconnected plate by means of a severing means which is movable horizontally in the plane of the gripped plate, and that the severed object supports are each separated and passed into a respective container associated therewith.

It will be seen that in this way the cup-shaped object supports may be severed and simultaneously passed to a glass reagent vessel, in a single working operation. The method may be carried out in a particularly advantageous manner if the severing means is guided over the object supports by means of a movable carriage. The individual object supports are reliably separated from the remainder of the interconnected plate by the operation of the object supports being horizontally severed by means of the severing device. It is not possible for the object supports to remain clinging to the plate or the tool, as may happen for example when a punching or stamping operation is used, as the cutting tool is moved forwardly and therefore comes into contact with the individual object supports for only a short period of time. Distribution of the object supports by means of the distributor passages prevents the individual object supports from being lost or confused with each other.

The invention relates to apparatus for severing the object supports, which has a gripping means for fixing the support plate, and a severing means which is mounted approximately at the plane of the gripping means on a movable carriage and which also has a distributor means for distributing the severed object supports, the distributor means being disposed below the gripping means. A particularly good mode of operation of the apparatus is ensured when the gripping means has a perforated member whose openings correspond in respect of size and arrangement to the cup-shaped object supports on the support plate, when a holding cover member for holding the support plate down in the gripping means is secured to the gripping means, when a perforated plate is mounted at a spacing below the perforated member and is provided with vertical bores for receiving the cup-shaped object supports, and when the openings in the perforated member are arranged vertically precisely above the bores in the perforated plate. The support plate can be fixedly gripped and secured by means of the perforated member and the holding cover member. When this is done, each opening of the perforated member accommodates and firmly retains a cup-shaped object support. In order to ensure that the cup-shaped object supports cannot bend away during the cutting operation, the individual object supports are also held and supported by a perforated plate, below the perforated member.

The horizontal opening between the perforated member and the perforated plate is provided for the passage therethrough of the severing means which advantageously comprises a relatively thin saw blade. In order to operate the saw blade, the saw blade is mounted on the movable carriage by means of a spring on one side, while on the other side the saw blade is gripped in an electrically operable vibrator means. The co-operation of the vibrator means and the spring cause the saw blade to be reciprocated in the horizontal opening and thus make is possible for the cup-shaped object supports to be severed without difficulty, with the carriage moving forwardly at the same time.

Inadvertent opening of the holding cover member can be avoided by the movable carriage having a pressure roller for pressing the cover member onto the perforated member during the cutting operation. This pressure roller is advantageously so arranged that the cover member can be opened again only when the carriage with the severing means has been retracted into its original starting position. This arrangement provides in a very simple manner that it is not possible for anyone to make an attempt to sever the object supports when retracting the carriage.

The apparatus provides a simple mode of distributing the severed object supports by virtue of the distributor means having a distributor block with distributor passages whose axes lead from the upper boundary plane below the perforated plate, in a truncated pyramid configuration, to the lower boundary plane, and that the openings of the distributor passages at the upper boundary plane are disposed precisely below the bores in the perforated plate. As the object supports are relatively close to each other on the support plate, it is necessary for the object supports to be separated from each other, after the severing operation, in such a way that they pass into an associated glass reagent vessel, without additional work being required. This operation is made possible, in particularly simple manner, by virtue of the distributor block with the distributor passages arranged in a truncated pyramid configuration. By virtue of this arrangement, the object supports are moved so far apart from each other that an associated glass reagent vessel can be associated with each object support, below the distributor block.

The glass reagent vessels can be moved into position below the corresponding openings of the distributor passages by means of a container carrier which can be inserted into a recess means below the distributor block. The recess means for inserting the container carrier determines the precise position of the carrier, by virtue of the side walls of the recess. In order to ensure that the container carrier cannot be inserted into the recess means in the reversed position, the container carrier is provided with a special guide groove. This ensures that the glass reagent vessels cannot move into position below the openings of the distributor passages, in a side-to-side reversed sequence. The container carrier can also be secured in the recess means by means of a locking bolt, whereby there is no possibility of the glass reagent vessels being unintentionally moved during the operation of separating or distributing the object supports.

An embodiment of the invention is described in greater detail hereinafter and shown in the drawings in which.

Figure 1:
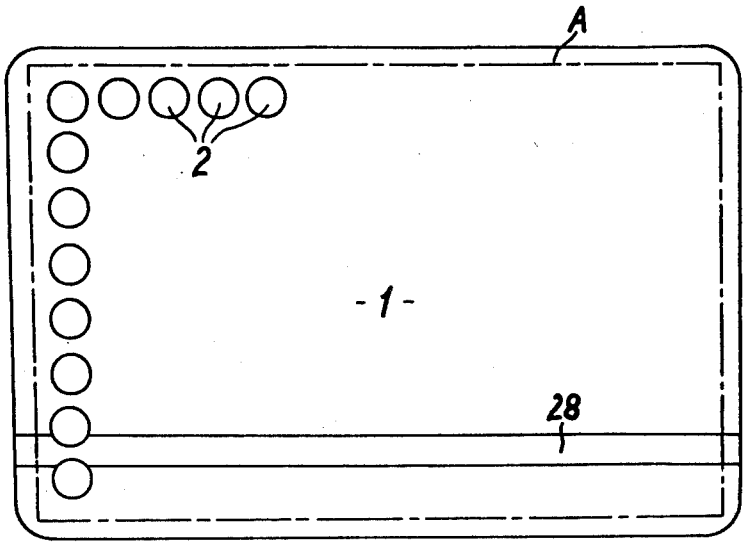
FIG. 1 shows a plan view of a support plate with object supports.
Figure 2:
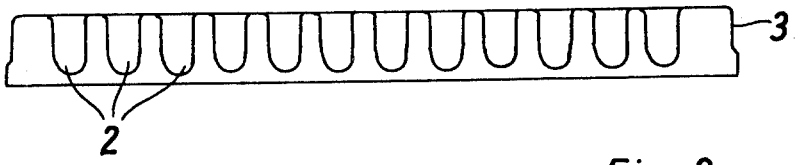
FIG. 2 shows a view in cross-section through the plate of FIG. 1.

As shown in FIGS. 1 and 2, a support plate 1 comprises a plurality of interconnected object supports 2 and a reinforced plate rim or edge portion 3 which extends around the support plate 1. The support plate 1 measures approximately 80×120 mm and contains a total of ninety-six object supports in twelve rows, each row comprising eight articles. As the object supports 2 must be treated in a given sequence and must be identifiable at any time, the plate 1 carries a marking strip 28 on one side. The marking strip forms an aid to orientation and thus makes it possible for each individual object support to be identified by number at any time. Before the support plate is inserted into the apparatus according to the invention, the reinforced rim or edge portion 3 is severed approximately along line A.

Figure 3:
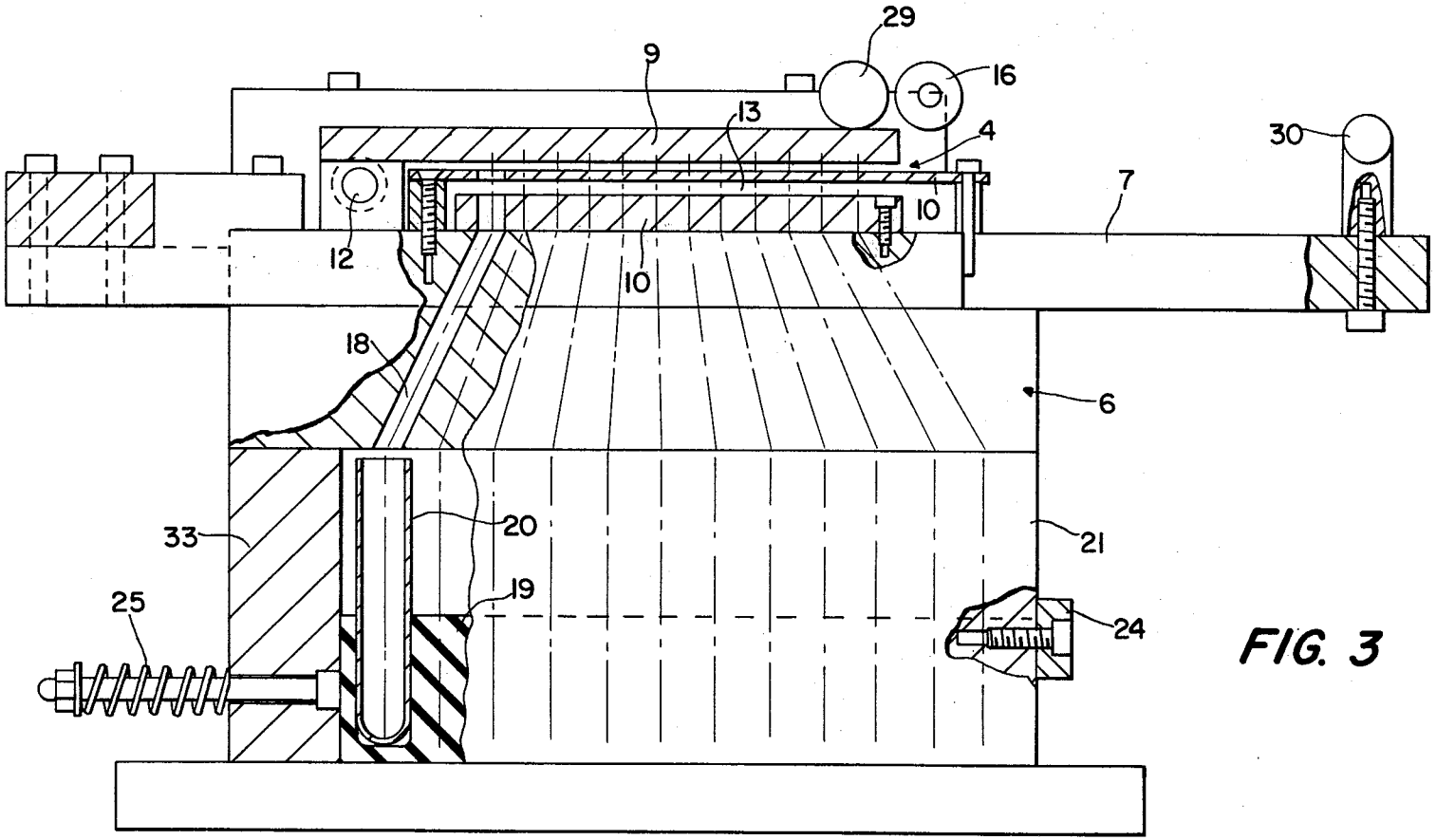
FIG. 3 shows a partly sectional side view of apparatus according to the invention.
Figure 4:
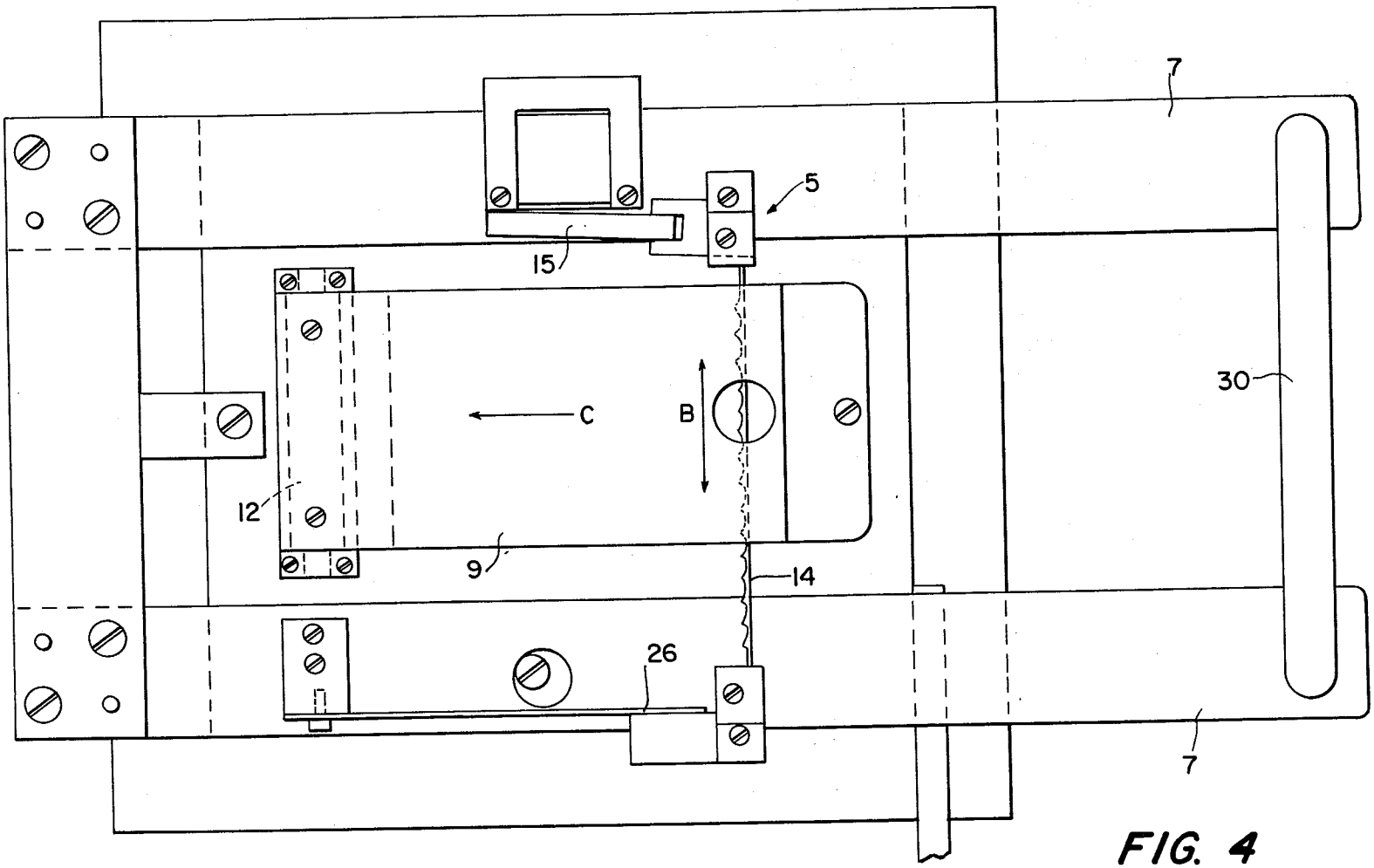
FIG. 4 shows a plan view of FIG. 3.
Figure 5:
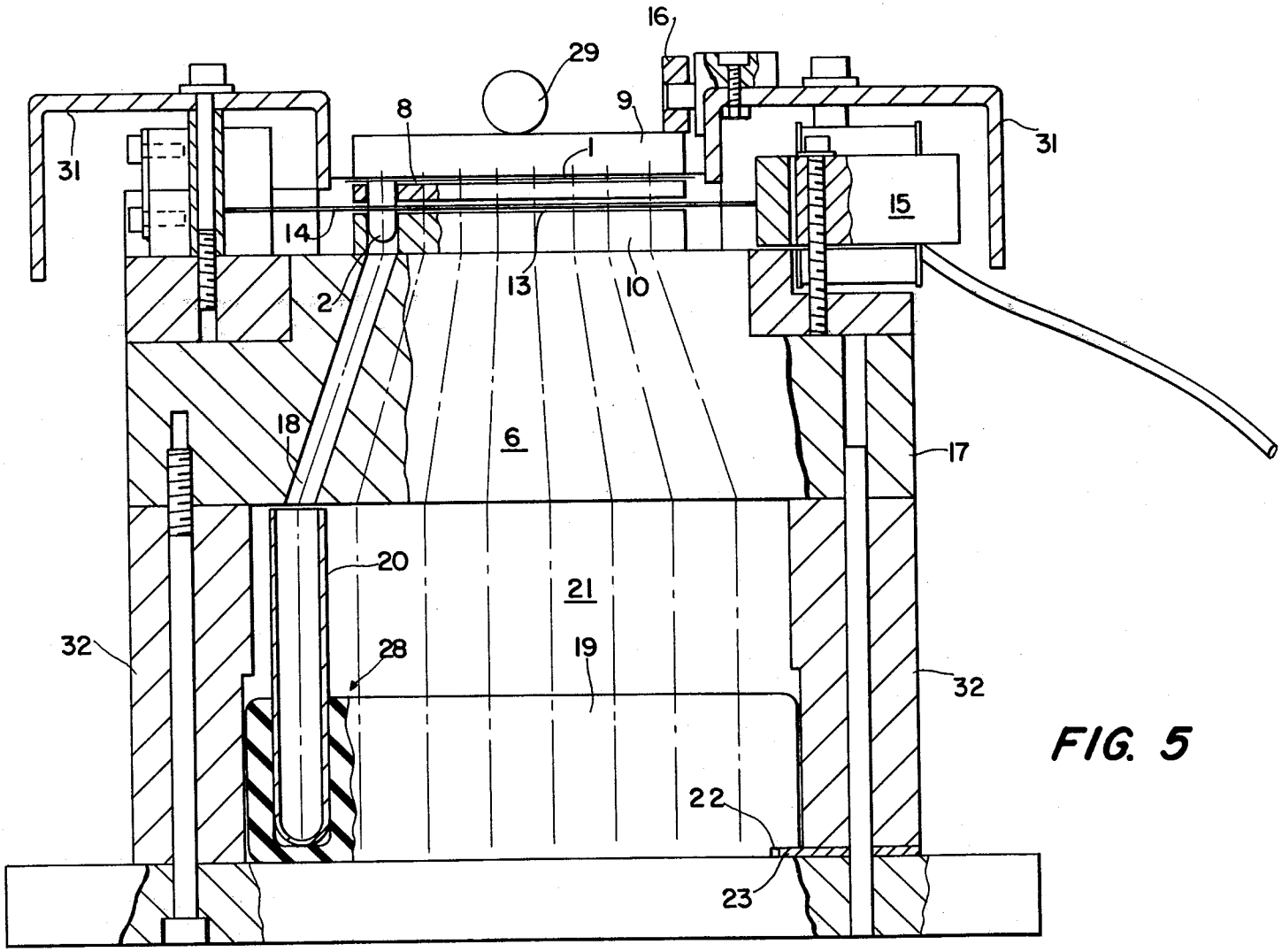
FIG. 5 shows a simplified cross-sectional view of the apparatus.

As shown in FIGS. 3, 4 and 5, the apparatus essentially comprises three main components, namely, a gripping means 4, a severing means 5 and a distributor means 6. The gripping means essentially comprises a perforated member 8 whose openings precisely coincide with the arrangement of the cup-shaped object supports 2. A perforated plate 10 is secured below the perforated member 8 at a given spacing therefrom, and the bores in the perforated plate 10 also correspond to the openings in the perforated member. A holding cover member 9 is secured to the gripping means 4 by way of a hinge 12 and has a handle 29 for easier handling thereof. The plate 1 with the object supports 2 is pressed against the perforated member 8 and held firm in position, by means of the cover member 9. The severing means 5 is mounted on a movable carriage 7, on the plane of the gripped plate 1. The carriage 7 can be moved backwards and forwards by means of the handle 30. When this is done, a saw blade 14 also moves at the same time in the horizontal opening 13 between the perforated member 8 and the perforated plate 10. On one side of the carriage 7, the saw blade 14 is connected to a spring 26 while on the other side it is gripped in a vibrator means 15. By virtue of the co-operation between the spring and the vibrator means, the saw blade 14 is reciprocated in the direction indicated by arrow B and thus permits the object supports 2 to be severed without difficulty, when the severing means 5 is moved forwardly in the direction indicated at C.

In order to provide protection from injury, the severing means 5 is covered on both sides of the carriage 7, in particular over the spring 26 and the vibrator means 15, by shaped protection members 31. A pressure roller 16 is provided on one side of the carriage 7 for pressing the cover member 9 onto the perforated member 8. The pressure roller 16 is advantageously mounted in such a way that the cover member 9 can be opened only if the carriage 7 has been returned to its starting position. This arrangement ensures that the cover member 9 cannot be re-opened before the saw blade 14 has been retracted in the horizontal opening 13. The pressure roller 16 thus also provides safety functions.

It would obviously also be possible to use for example a hot wire for severing the object supports 2, instead of the saw blade 14. Other severing means such as for example a movable blade or a saw wire would also be conceivable.

After the cup-shaped object supports 2 have been severed from the support plate 1, the object supports are passed to the respective glass reagent vessels 20 associated therewith, by means of the distributor means 6. The distributor means comprises a distributor block 17 which can serve at the same time as a guide means for the carriage 7. Arranged in the distributor block 17 are the distributor passages 18 which lead downwardly from the upper boundary plane, in the configuration of a truncated pyramid. Thus, each individual distributor passage begins directly below a bore in the perforated plate 10 and terminates above a glass reagent vessel 20 associated with that bore. This means that the severed object supports 2 are distributed into the respective associated reagent vessels 20 in a particularly simple manner. If the distributor block 17 comprises plastic material, the distributor passages 18 can be formed either by boring or directly by being cast in the distributor block.

The reagent vessels 20 are carried by a container carrier 19 which can be inserted into the recess means 21 below the distributor block 17. In this arrangement, the side walls 32 and the rear wall 33 of the recess means 21 define the precise position for the container carrier 19. The container carrier 19 can be fixed in the recess means 21 by means of a locking bolt 24 during the severing operation. In order to ensure that the carrier 19 cannot be inserted into the recess means 21 in the wrong direction, a guide groove 22 is provided on one longitudinal side of the carrier 19 and co-operates with a projection 23 on one side wall of the recess means.

As an aid to proper orientation and in order to ensure that both the support plate 1 and the container carrier 19 are always handled in the proper position, a marking strip 28 is provided on the perforated plate 10 and on the top side of the container carrier 19. In order to facilitate withdrawing the carrier 19 from the recess means 21, an ejection pin member 25 is secured to the rear wall 33.

It will be seen that the apparatus according to the invention is not restricted to the embodiment shown in the drawings. Thus, the distributor means 6 in particular could assume various possible forms, without thereby departing from the subject of the invention. The distributor passages 18 in the distributor block 17 could be replaced for example by individual conduits which are held together by a frame. It would also be possible for the distributor means to comprise a single compartment-like distributor plate which is moved stepwise, together with the severing means, over the individual rows of reagent vessels.

I claim:

1. Apparatus for severing and separating a plurality of cup-shaped object supports of plastic material, which are interconnectedly arranged on a support plate, characterised by a gripping means (4) for fixing the support plate (1) in the plate regions between the individual object supports, a severing means (5) for severing the object supports (2) and a distributor means (6) for distributing the severed object supports (2), which distributor means is arranged below the gripping means (4), and further characterised in that the gripping means has a perforated member (8) whose openings correspond in respect of diameter and geometrical arrangement to the cup-shaped object supports on the support plate (1) in respect of the outside diameter and the arrangement thereof, that a holding cover member (9) is secured to the gripping means for holding down the support plate (1) in the gripping means, that a perforated plate (10) is mounted at a spacing below the perforated member (8) and is provided with vertical bores for receiving the cup-shaped object supports (2), that the openings in the perforated member are arranged vertically above the bores in the perforated plate and are in alignment therewith, and that the severing means is arranged displaceably in the gap between the perforated member and the perforated plate.

2. Apparatus according to claim 1 characterised in that the holding cover member is secured to the gripping means pivotally by means of a hinge (12).

3. Apparatus according to claim 1 characterised in that a horizontal opening (13) for the passage therethrough of the severing means is provided between the perforated member and the perforated plate.

4. Apparatus according to claim 1 characterised in that the severing means (5) has a saw blade (14) which is movable with a movable carriage (7) in a horizontal gap (13) between the perforated member (8) and the perforated plate (10).

5. Apparatus according to claim 4 characterised in that the saw blade (14) is mounted on the movable carriage (7) by means of a spring (26) on one side and is gripped on the other side in an electrically operable vibrator means (27).

6. Apparatus according to claim 1 characterised in that the severing means has a heatable wire which is displaceable with a movable carriage in a horizontal opening between the perforated member and the perforated plate.

7. Apparatus according to claim 4 characterised in that the movable carriage (7) has a pressure roller (16) for pressing the cover member (9) onto the perforated member (8) during the cutting operation.

8. Apparatus according to claim 1 characterised in that the distributor means (6) has a plurality of distributor passages (18) whose axes lead from the upper boundary plane below the perforated plate, in a truncated pyramid configuration, to the lower boundary plane, and that the openings of the distributor passages at the upper boundary plane are disposed below and in alignment with the bores in the perforated plate (10).

9. Apparatus according to claim 8 characterised in that the distributor means (6) has (17) a recess means (21) for inserting a container carrier (19) below the lower openings of the distributor passages (18).

10. Apparatus for severing and separating a plurality of cup-shaped object supports of plastic material, which are interconnectedly arranged on a support plate, characterised by a gripping means for fixing the support plate in the plate regions between the individual object supports, a severing means for severing the object supports, and a distributor means for distributing the severed object supports, which distributor means is arranged below the gripping means, and further characterised in that the distributor means has a plurality of distributor passages whose axes lead from the upper boundary plane below the perforated plate, in a truncated pyramid configuration, to the lower boundary plane, that the openings of the distributor passages at the upper boundary plane are disposed below and in alignment with the bores in the perforated plate, that the distributor means has a recess means for inserting a container carrier below the lower openings of the distributor passages, that the container carrier is provided with vertical bores for receiving reagent glass vessels whose position corresponds to the discharge openings of the distributor passages, and that a guide groove is provided at the longitudinal side of the container carrier in the direction of insertion thereof, the guide groove cooperating with a projection on the side wall of the recess means.

11. Apparatus according to claim 10 characterised in that the container carrier (19) can be fixed in the recess means (21) by a lock bolt (24) and can be ejected from the recess means by an ejection pin (25).

* * * * *